US006392175B1

(12) United States Patent
Bauer et al.

(10) Patent No.: US 6,392,175 B1
(45) Date of Patent: May 21, 2002

(54) CONTROL ELEMENT FOR CONTROL FUNCTIONS

(75) Inventors: Karl-Heinz Bauer, Bad Neustadt; Reinhold Moret, Mellrichstadt; Joachim Storath, Salz, all of (DE)

(73) Assignee: Preh-Werke GmbH & Co. KG, Bad Neustadt/Saale (DE)

( * ) Notice: Subject to any disclaimer, the term of this patent is extended or adjusted under 35 U.S.C. 154(b) by 0 days.

(21) Appl. No.: 09/544,470

(22) Filed: Apr. 7, 2000

(30) Foreign Application Priority Data

Apr. 9, 1999 (DE) ..... 199 15 990

(51) Int. Cl.[7] ..... H01H 9/26

(52) U.S. Cl. ..... 200/310; 200/5 R; 200/316; 200/317; 200/336

(58) Field of Search ..... 200/5 R, 17 R, 200/18, 564, 567, 308, 310, 313, 316, 317, 336; 362/487–490, 23, 26, 31, 36, 85, 551, 555

(56) References Cited

U.S. PATENT DOCUMENTS 5,736,696 A * 4/1998 Del Rosso ..... 200/5 R
5,861,589 A 1/1999 Sato et al.
5,913,414 A * 6/1999 Pollock et al. ..... 200/316
6,155,691 A * 12/2000 Miyasaka ..... 362/30
6,224,221 B1 * 5/2001 Glienicke ..... 362/23

FOREIGN PATENT DOCUMENTS

| | | | |
|---|---|---|---|
| DE | 29501692.2 | 5/1995 | ..... H01H/3/50 |
| DE | 19539081 | 4/1997 | ..... H01H/9/18 |
| FR | 2756067 | 5/1998 | ..... G05G/9/00 |

* cited by examiner

*Primary Examiner*—Michael Friedhofer
(74) *Attorney, Agent, or Firm*—Birch, Stewart, Kolasch & Birch, LLP

(57) ABSTRACT

A control element for control functions within a passenger area of a vehicle having several turning knobs whose positions are indicated by an illumination display, includes an LED (Light Emitting Device) and a light-guide coupled directly with the LED and having a light-exit surface that is coupled with a light-entry surface leading to at least one turning knob, a light-conducting plate (7) adjacent the light-guide, and a housing. The light guide (4) is connected with the turning knob (2) and has, on axial surfaces (8,9) at an outer rim (10), indexing bumps and indexing indentations (11, 12), respectively, that cooperate with retaining catches (13) of a retaining spring (14) that is pushed onto the light-conducting plate (7) within retaining ribs (15) and is locked between an edge of the light-conducting plate (16) and a housing rib (17) in the push-on

4 Claims, 2 Drawing Sheets

CONTROL ELEMENT FOR CONTROL FUNCTIONS

BACKGROUND OF THE INVENTION

This invention relates to a control, or manipulation, element for control functions within a passenger area of a vehicle having a plurality of tuning knobs whose positions are indicated by an illumination display, including an LED (Light Emitting Device) and a light-guide, in which a turning knob includes the light guide that is coupled directly with the LED and has a light-exit surface that is coupled with a light-entry surface leading to the other turning knobs Control elements of this type are required, for example, for the control functions of air conditioning or ventilation equipment. Indexing of a turning knob in intermediate positions is required, particularly for adjusting temperatures, with end positions being held more securely.

Conventional indexing devices in the prior art (German patent document DE295 01 692 U1) have snapping elements such as spring balls, leaf springs, etc., that result in a significant load on bearings, etc., causing, in addition to wear, undue binding of the turning knob.

It is an object of this invention to provide a sensitive indexing of a turning knob of this type without requiring an undue increase in an adjusting force.

SUMMARY OF THE INVENTION

According to principles of this invention a light guide is connected to a turning knob and has, on axial surfaces at an outer rim, indexing bumps and indexing indentations, respectively, that cooperate with retaining catches of a retaining spring that is pushed onto a light-conducting plate within retaining ribs and is locked between an edge of the light-conducting plate and a housing rib in the pushed-on direction.

BRIEF DESCRIPTION OF THE DRAWING

The invention is described and explained in more detail below using an embodiment shown in the drawings. The described and drawn features can be used individually or in preferred combinations in other embodiments of the invention. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
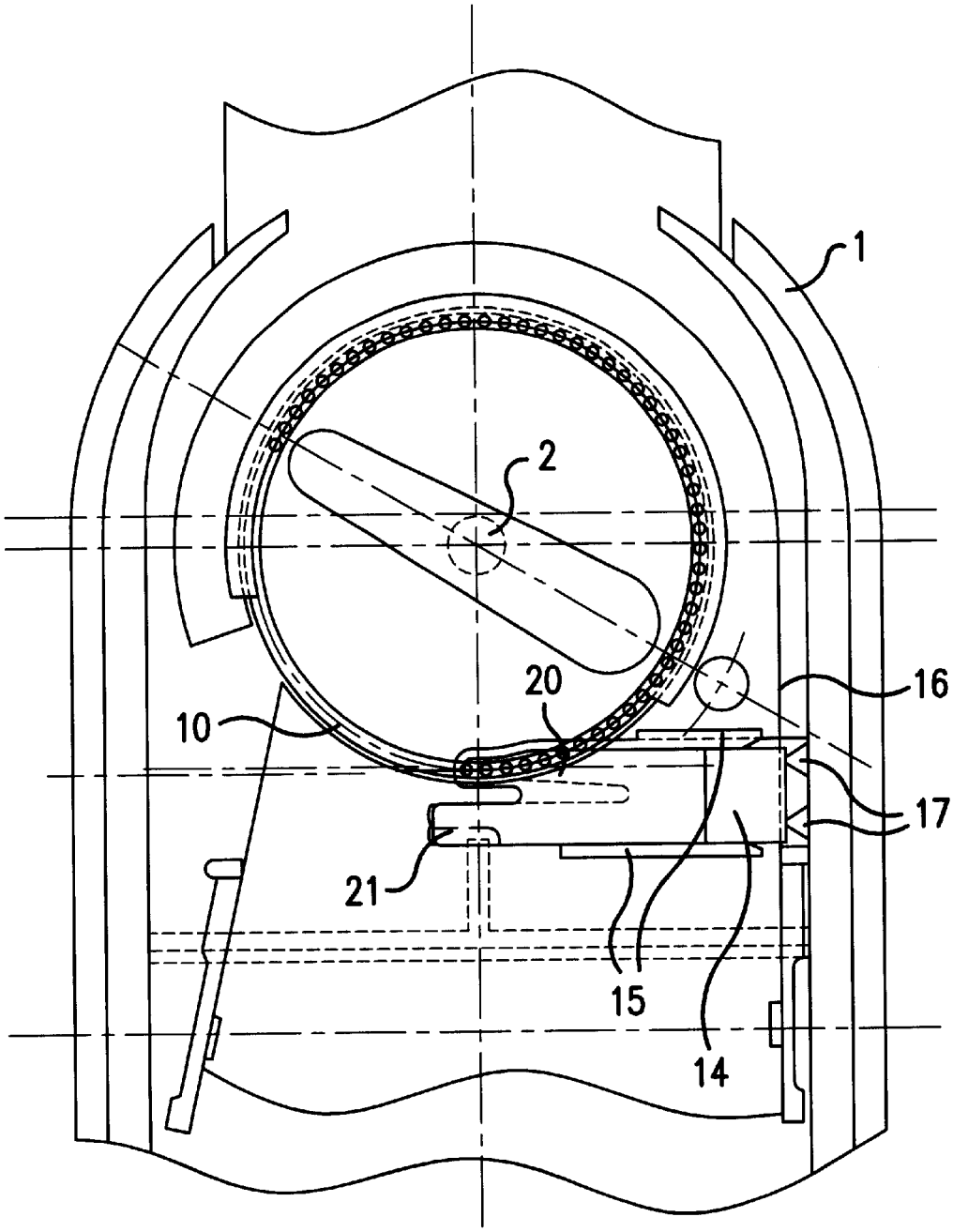
FIG. 1 is a plan cutaway view of a control element of this invention.

FIG. 1 shows an opened control element housing 1, in which one of a plurality of turning knobs 2, only one being shown, is located, the position of the one being indicated by an illuminated display including an LED (Light Emitting Device) and a fiber optical light guide 4 rigidly connected with the turning knob 2.

Figure 2:
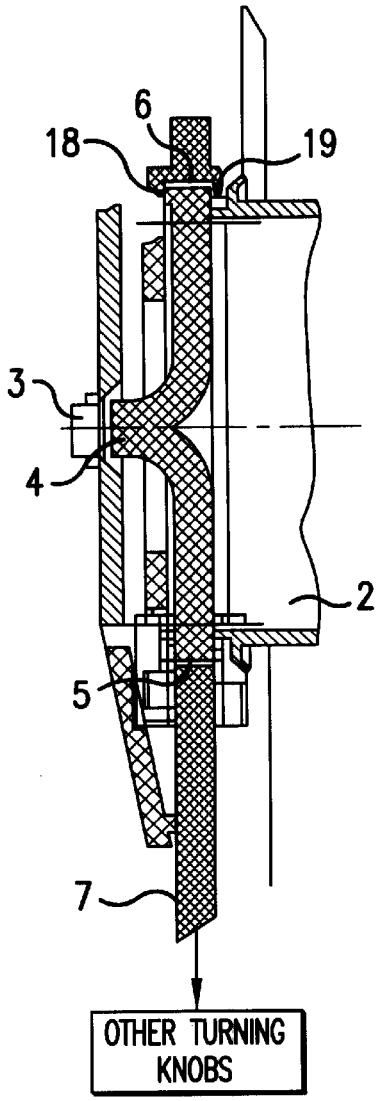
FIGS. 2 and 3 are sectional views taken of the structure of FIG. 1 with FIG. 2 showing additional knobs schematically.

As can be seen in FIG. 2, in which a cross section of the control element housing 1 taken through the turning knob 2 is shown, the light guide 4 cooperates directly with the LED 3 and has a light-exit surface 5 that cooperates with a light-entry surface 6 of a light-conducting plate 7, which is coupled to other turning knobs.

It is provided that the light guide 4 connected to the turning knob 2 has, on axial surfaces 8, 9 at an outer rim 10, respectively indexing bumps and depressions 11, 12, that cooperate with retaining catches 13 of a retaining spring 14 that is pushed onto the light-conducting plate 7 within retaining ribs 15 and is affixed between an edge 16 of the light-conducting plate 7 and a housing rib 17 in a pushing-on direction.

Figure 3:
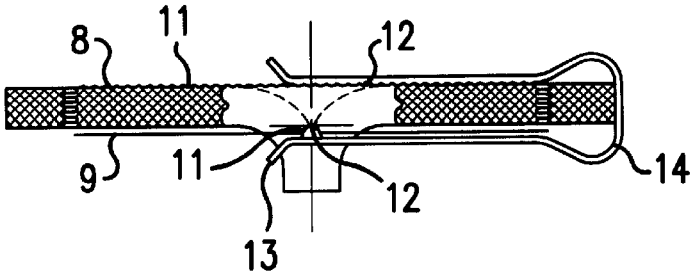

It is clear from FIG. 1 that the indexing bumps and indexing indentations 11, 12 are positioned in close sequence on the axial surface 8 for sensitive indexing in intermediate positions, and that, on the other axial surface 9, only indexing bumps, and respectively one indexing indentation 11, 12 for locking in each end position of the turning knob 2, are provided, as shown in FIG. 3 in which a cross-sectional cut of the control element housing is made in the direction of the retaining spring.

It is particularly advantageous if the fiber optical light guide 4 connected with the turning knob 2 is positioned with its light-exit surface 5 inside the light-entry surface 6 of the light-conducting plate 7, radially and axially, with its axial surfaces 8, 9 at the rim 10 inside axial surfaces 18, 19 of the light-conducting plate 7, thereby providing a cost-effective embodiment.

It is provided that the retaining spring 14 has a first retaining pair 20 for cooperating with the indexing bumps and indexing indentations 11, 12 and a second retaining arm pair 21 for clipping onto the light-conducting plate 7.

These retaining arm pairs 20, 21 effect an force balancing of opposing supporting forces, so that there is no loading of a bearing.

The invention claimed is:

1. A control element for control functions within a passenger area of a vehicle, having several turning knobs whose positions are indicated by an illumination display, an LED (Light Emitting Device), a light-guide coupled directly with the LED and having a light-exit surface that is coupled with a light-entry surface leading to at least one of the several turning knobs, a light-conducting plate (7) adjacent said light-guide, and a housing, wherein the light guide (4) is connected with at least one of the several turning knobs, and has, on first and second axial surfaces (8,9) at an outer rim (10), indexing bumps and indexing indentations (11,12), respectively, that cooperate with at least one retaining catch (13) of a retaining spring (14) that is pushed onto said light-conducting plate (7) within retaining ribs (15) and is locked between an edge of the light-conducting plate and a housing rib (17) in a pushed-on direction.

2. The control element as in claim 1, wherein first ones of said indexing bumps and said indexing indentations (11,12) are arranged in close sequence on the first axial surface (8) for sensitive locking in intermediate positions, and wherein, on the second axial surface (9), second ones of said indexing bumps and said indexing indentations (11,12) are only for snapping in end positions of the at least one of the several turning knobs.

3. The control element as in claim 2, wherein the light entry surface is on the light-conducting plate, and wherein the light guide (4) connected with the at least one of the several turning knobs is situated with a light guide light-exit surface (5) inside a light-entry surface (6) of the light-conducting plate (7) radially, and axially with the first and second axial surfaces (8,9) of the rim (10) inside axial surfaces (18,19) of the light-conducting plate (7).

4. The control element as in claim 1, wherein the retaining spring (14) has a first retaining arm pair (20) for snapping with the indexing bumps and the indexing indentations (11,12) and a second retaining arm pair (21) for clipping onto the light-conducting plate (7).

* * * * *